US010493610B2

(12) United States Patent
Koizumi et al.

(10) Patent No.: US 10,493,610 B2
(45) Date of Patent: Dec. 3, 2019

(54) HYDRAULIC HAMMERING DEVICE

(71) Applicant: Furukawa Rock Drill Co., Ltd., Chuo-ku, Tokyo (JP)

(72) Inventors: Masahiro Koizumi, Takasaki (JP); Susumu Murakami, Takasaki (JP); Toshio Matsuda, Takasaki (JP); Tomohiro Goto, Takasaki (JP); Shunsuke Echigoya, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 411 days.

(21) Appl. No.: 15/113,664

(22) PCT Filed: Jan. 30, 2015

(86) PCT No.: PCT/JP2015/000409
§ 371 (c)(1),
(2) Date: Jul. 22, 2016

(87) PCT Pub. No.: WO2015/115106
PCT Pub. Date: Aug. 6, 2015

(65) Prior Publication Data

US 2017/0001294 A1 Jan. 5, 2017

(30) Foreign Application Priority Data

Jan. 31, 2014 (JP) ..... 2014-017840
Jan. 31, 2014 (JP) ..... 2014-017842
Jan. 31, 2014 (JP) ..... 2014-017843

(51) Int. Cl.
*B25D 9/20* (2006.01)
*B25D 9/12* (2006.01)

(52) U.S. Cl.
CPC ..... *B25D 9/20* (2013.01); *B25D 9/12* (2013.01); *B25D 2209/005* (2013.01)

(58) Field of Classification Search
CPC ... B25D 9/00; B25D 9/14; B25D 9/16; B25D 9/18
(Continued)

(56) References Cited

U.S. PATENT DOCUMENTS 3,322,210 A 5/1967 Arndt
4,039,033 A * 8/1977 Salmi ..... B25D 9/12 173/105
(Continued)

FOREIGN PATENT DOCUMENTS

EP 0919339 A1 6/1999
GB 1 340 017 12/1973
(Continued)

OTHER PUBLICATIONS

Extended European Search Report dated Jun. 26, 2017 issued for corresponding European Patent Application No. 15743909.2.
(Continued)

*Primary Examiner* — Alexander M Valvis
*Assistant Examiner* — Daniel Jeremy Leeds
(74) *Attorney, Agent, or Firm* — Young Basile Hanlon & MacFarlane, P.C.

(57) ABSTRACT

A hydraulic hammering device that uses a scheme in which a front chamber is switched into communication with a low-pressure circuit when a piston advances, wherein occurrences of "galling" to the piston at a sliding contact portion with a front-chamber liner is reduced. The front chamber has the front-chamber liner fitted to an inner surface of a cylinder. A hydraulic chamber space communicating with the front chamber and filled with hydraulic oil is formed as a cushion chamber on the inner peripheral surface of a rear portion of the front-chamber liner. The cushion chamber has a second drain circuit (from first end face grooves to slits to second end face grooves), which is provided separately from
(Continued)

a drain circuit that guides the hydraulic fluid passing through a liner bearing of the front-chamber liner to the low-pressure circuit.

7 Claims, 7 Drawing Sheets

(58) Field of Classification Search
USPC ..... 173/90
See application file for complete search history.

(56) References Cited

U.S. PATENT DOCUMENTS 4,181,183 A * 1/1980 Okada ..... B25D 9/12 173/204
4,281,587 A * 8/1981 Garcia-Crespo ..... B25D 9/12 91/290
4,508,017 A 4/1985 Montabert
4,550,785 A * 11/1985 Hibbard ..... B25D 9/12 173/206
5,056,606 A * 10/1991 Barthomeuf ..... B25D 9/145 173/13
5,117,921 A * 6/1992 Bartels ..... B25D 9/145 173/105
5,129,466 A * 7/1992 Bartels ..... B25D 9/145 173/13
5,653,295 A * 8/1997 Juvonen ..... B25D 9/145 173/207
5,884,713 A * 3/1999 Shinohara ..... B06B 1/183 173/206
5,893,429 A 4/1999 Hackl et al.
5,896,937 A 4/1999 Kaneko
6,364,032 B1 * 4/2002 DeCord, Jr. ..... B22D 31/00 173/162.1
7,419,015 B2 9/2008 Muuttonen et al.
7,628,223 B2 * 12/2009 Andersson ..... B25D 17/26 173/197
7,958,947 B2 * 6/2011 Larsson ..... B25D 17/24 173/200
2001/0043007 A1 * 11/2001 Jang ..... B25D 9/145 299/69
2003/0136569 A1 * 7/2003 Gotou ..... B25D 9/145 173/11
2005/0145400 A1 * 7/2005 Ottestad ..... B25D 9/12 173/91
2008/0105115 A1 * 5/2008 Weddfelt ..... B25D 9/12 91/50
2008/0135270 A1 * 6/2008 Henriksson ..... B25D 9/20 173/207
2009/0223720 A1 * 9/2009 Patterson ..... B25D 9/18 175/296
2009/0321099 A1 * 12/2009 Birath ..... B25D 9/16 173/1
2010/0155096 A1 6/2010 Morrison
2011/0220421 A1 * 9/2011 Muuttonen ..... B25D 9/14 175/293
2012/0138328 A1 * 6/2012 Teipel ..... B25D 9/12 173/207
2014/0144660 A1 * 5/2014 Sangster ..... E21B 6/08 173/112
2015/0083501 A1 * 3/2015 Lundgren ..... B25D 9/20 175/122
2015/0129269 A1 * 5/2015 Muuttonen ..... E21B 1/02 173/105
2015/0197988 A1 * 7/2015 Lee ..... E21B 4/14 173/125
2017/0080554 A1 * 3/2017 Moore ..... B25D 9/04
2018/0133882 A1 * 5/2018 Moore ..... B25D 9/04

FOREIGN PATENT DOCUMENTS

GB 1396307 A 6/1975
JP S46-001590 A 9/1971
JP S57-174594 A 10/1982
JP S58-071082 A 4/1983
JP S61-169587 U 10/1986
JP H02-024623 Y2 7/1990
JP H05-039877 U 2/1993
JP H09-109064 A 4/1997
JP H11-006383 A 1/1999
JP 2012-509199 A 4/2012
WO 2005000532 A1 1/2005
WO 2005058550 A1 6/2005
WO 2011123020 A1 10/2011
WO 2012168559 A1 12/2012

OTHER PUBLICATIONS

Partial European Search Report dated Mar. 6, 2017, issued for corresponding European Patent Application No. 15743909.2.
Chinese Office Action in corresponding Chinese Application No. 201580004614X dated Mar. 3, 2017, Partial English Translation attached, 8 pp.
English translation of International Preliminary Report on Patentability in PCT/JP2015/000409 dated Aug. 11, 2016.

* cited by examiner

HYDRAULIC HAMMERING DEVICE

TECHNICAL FIELD

The present invention relates to a hydraulic hammering device, such as a rock drill and a breaker.

BACKGROUND

With regard to a hydraulic hammering device of this type, for example, a technology disclosed in JP 61-169587 U has been known.

A hydraulic hammering device disclosed in JP 61-169587 U includes a piston that has a large-diameter section in the axially middle thereof and small-diameter sections formed in front and the rear of the large-diameter section. The piston being disposed in a slidably fitted manner into a cylinder causes a front chamber and a rear chamber to be defined individually between an outer peripheral surface of the piston and an inner peripheral surface of the cylinder.

While the front chamber is always communicated with a high pressure circuit, the rear chamber is communicated with either the high pressure circuit or a low pressure circuit alternately by a switching valve mechanism. Pressure receiving areas of a front side portion and a rear side portion are differentiated from each other so that the piston can move in the hammering direction when the rear chamber is in communication with the high pressure circuit, and this configuration enables an advance and a retraction of the piston to be repeated in the cylinder (hereinafter, also referred to as "rear chamber alternate switching method").

While, as described above, the hydraulic hammering device disclosed in JP 61-169587 U, which employs the "rear chamber alternate switching method", moves the piston in the hammering direction in hammering using a pressure receiving area difference, hydraulic oil on the front chamber side acts in such a way as to resist a movement of the piston in the hammering direction because the front chamber is always in communication with the high pressure circuit. Thus, to further improve hammering efficiency, there is room for improvements.

On the other hand, in for example JP 46-001590 A, a hydraulic hammering device that switches each of a front chamber and a rear chamber into communication with either a high pressure circuit or a low pressure circuit in an interchanging manner is disclosed (hereinafter, also referred to as "front/rear chamber alternate switching method"). Since, in a hydraulic hammering device employing the "front/rear chamber alternate switching method", the front chamber is switched into communication with the low pressure circuit when a piston advances, there is no occasion that hydraulic oil on the front chamber side resists a movement of the piston in the hammering direction. Therefore, the hydraulic hammering device is suitable to improve hammering efficiency.

SUMMARY

However, in a hydraulic hammering device employing the "front/rear chamber alternate switching method", a rapid variation in the pressure of hydraulic oil is caused in the front chamber in a regular hammering phase in which the piston transitions from a hammering step in which the piston advances to a retraction step in which the piston is reversed to retraction. Such a variation in the pressure of hydraulic oil in the front chamber does not become a significant problem for a hydraulic hammering device employing the "rear chamber alternate switching method" because, in such a hydraulic hammering device, the front chamber is always in communication with a high pressure circuit. On the other hand, for a hydraulic hammering device employing the "front/rear chamber alternate switching method", there is a problem in that a lot of minute bubbles, that is, cavitation, becomes likely to be produced in hydraulic oil. There is another problem in that erosion is caused by shock pressure due to the collapse of cavitation.

The inventors have realized that the above-described problem of occurrences of cavitation in the front chamber is basically caused by the fact that pressure in the front chamber becomes low when the piston advances because the front chamber is switched into communication with a low pressure circuit when the piston advances. That is, in addition to the above-described "front/rear chamber alternate switching method" in which pressure in the front chamber becomes low when the piston advances, a "front chamber alternate switching method" (see, for example, JP 05-039877 U) in which the rear chamber always has a high pressure connection and the front chamber is switched to high pressure or low pressure alternately also has the same problem.

Accordingly, the present invention is made focusing attention on such problems, and an object of the invention is to provide a hydraulic hammering device that is capable of preventing or suppressing occurrences of cavitation in a front chamber in a hydraulic hammering device employing a method that switches the front chamber into communication with a low pressure circuit when a piston advances.

A hydraulic hammering device, such as a rock drill (drifter drill), is sometimes provided with a cushion chamber in a front chamber as a braking mechanism to prevent a large-diameter section of a piston from striking against a cylinder at the front stroke end of the piston As an example in which a cushion chamber is formed to a front chamber is illustrated in FIG. 7, in the example, a hydraulic chamber space that is filled with hydraulic oil is defined at a rear section of a front-chamber liner 130, and the hydraulic chamber space works as a cushion chamber 103 that is in communication with a front chamber 102. When a large-diameter section 121 of a piston 120 comes into the cushion chamber 103, the cushion chamber 103 changes the hydraulic chamber into a closed space to restrict the movement of the piston 120. At this time, when pressurized oil flows out of the cushion chamber 103 to the front chamber 102 side with a high velocity, portions at which the flow velocity of pressurized oil is high become a cause for occurrences of local cavitation.

In order to achieve the object mentioned above, according to a first mode of the present invention, there is provided a hydraulic hammering device including: a piston slidably fitted into a cylinder, the piston being configured to advance and retract to hammer a rod for hammering; a front chamber and a rear chamber that are defined between an outer peripheral surface of the piston and an inner peripheral surface of the cylinder and arranged separated from each other in the front and rear direction; and a switching valve mechanism configured to switch the front chamber into communication with a low pressure circuit when the piston advances and to supply and discharge hydraulic oil so that an advance and a retraction of the piston can be repeated, wherein the front chamber has a front-chamber liner that is fitted to an inner surface of the cylinder, a hydraulic chamber space is formed to the front-chamber liner as a cushion chamber, the hydraulic chamber space communicating with the front chamber to be filled with hydraulic oil, and the cushion chamber has a second drain circuit that is formed separately from a drain circuit configured to guide hydraulic oil passing a liner bearing section of the front-chamber liner to the low pressure circuit and that passes through portions other than the liner bearing section.

According to the hydraulic hammering device according to the first mode of the present invention, since the second drain circuit is formed separately from the drain circuit (hereinafter, also referred to as "first drain circuit"), which guides hydraulic oil passing the liner bearing section of the front-chamber liner to the low pressure circuit, and passes through portions other than the liner bearing section, it is possible to make hydraulic oil in the cushion chamber leak from a portion other than the liner bearing section to the low pressure circuit. Therefore, when pressurized oil is compressed to be brought to an ultrahigh pressure state in the cushion chamber, such as when in a "shank rod advanced state", hydraulic oil that flows out of the cushion chamber in the front-chamber liner can be released from a portion other than the liner bearing section to the "second drain circuit". Since the second drain circuit makes hydraulic oil leak from a portion other than the liner bearing section to the low pressure circuit, a clearance required for the liner bearing section can be maintained and hammering efficiency in regular hammering can be prevented from decreasing as much as possible.

Therefore, according to the hydraulic hammering device according to the first mode of the present invention, since adiabatic compression in the cushion chamber is relaxed compared with a case in which the "second drain circuit" is not provided, which is illustrated in FIG. 7 as a comparative example, a rise in oil temperature of hydraulic oil is also suppressed. Further, since the flow velocity of hydraulic oil that flows into the front chamber is reduced, local occurrences of cavitation are suppressed. Subsequently, although the front chamber is switched to high pressure by the switching valve mechanism, the suppressed cavitation enables heat generation due to the compression of cavitation to be relaxed and a rise in temperature of hydraulic oil to be reduced substantially. Therefore, expansion of a copper alloy portion of the front-chamber liner due to the rise in temperature of hydraulic oil is also relaxed. Therefore, occurrences of "galling" to the piston at sliding contact portions with the front-chamber liner can be reduced. While the passage area of the "first drain circuit" decreases rapidly due to expansion caused by a rise in temperature, the passage area of the "second drain circuit" is insusceptible to a rise in temperature.

Further, when focusing on piston movements when the piston advances to the front end of a stroke and stops there in the cushion chamber, pressurized oil supplied to the front chamber by valve switching is supplied into the cushion chamber through the clearance between the inner periphery of the rear liner and the large-diameter section of the piston and the piston turns to retraction. At this time, a portion of the pressurized oil is released by way of the "second drain circuit", causing an increase in pressure inside the cushion chamber to be gradual. Thus, the retraction speed of the piston is slowed down and the number of strikes per unit time when in the "shank rod advanced state" is reduced, causing a rise in oil temperature in the front chamber to be relaxed.

In the hydraulic hammering device according to the first mode of the present invention, it is preferable that the second drain circuit always communicate hydraulic oil in the cushion chamber with a low pressure circuit by way of one or more communication holes that pass through portions other than the liner bearing section, and that a total passage area of the one or more communication holes be, with respect to an amount of clearance of the liner bearing section (the area of an annular clearance formed by an opposing clearance in radially inward and outward directions between the small-diameter section of the piston and the sliding contact surface of the inner periphery of the front liner), set to an area within a predetermined range that is defined by the expression 1 below.

$$0.1Apf<A<2.5Apf \quad \text{(Expression 1)}$$

Where Apf: the amount of clearance of the liner bearing section, and

A: the total passage area of the communication holes.

Such a configuration is suitable to, while preventing a decrease in hammering efficiency in regular hammering as much as possible, suppress a rise in oil temperature when pressurized oil is compressed to be brought to an ultrahigh pressure state in the cushion chamber, such as when in the "shank rod advanced state". It is preferable that a choking mechanism be attached to the second drain circuit, which includes one or more communication holes being always in communication with a low pressure circuit.

In the hydraulic hammering device according to the first mode of the present invention, it is preferable that the front-chamber liner have, as each of the one or more communication holes, a radial communication passage that communicates with the cushion chamber and is formed in a penetrating manner separated from each other in the circumferential direction along a radial direction and an axial communication passage including a slit formed along the axial direction on an outer peripheral surface of the front-chamber liner at a position in alignment with the position of the radial communication passage so as to communicate with the radial communication passage, a drain port that communicates with the axial communication passage be formed between an outer peripheral surface at a front end side of the front-chamber liner and an inner peripheral surface of the cylinder and a low pressure port that is always in communication with the low pressure circuit be connected to the drain port, and the second drain circuit always communicate hydraulic oil in the cushion chamber with the low pressure circuit by way of the radial communication passage, the axial communication passage, and the drain port in this order. Such a configuration causes no low pressure port dedicated for the "second drain circuit" to be required and, thus, is suitable to form the "second drain circuit" while simplifying the structure thereof.

Furthermore, in order to achieve the object mentioned above, according to a second mode of the present invention, there is provided a hydraulic hammering device including: a piston slidably fitted into a cylinder, the piston being configured to advance and retract to hammer a rod for hammering; a front chamber and a rear chamber that are defined between an outer peripheral surface of the piston and an inner peripheral surface of the cylinder and arranged separated from each other in the front and rear direction; and a switching valve mechanism configured to switch the front chamber into communication with a low pressure circuit when the piston advances and to supply and discharge hydraulic oil so that an advance and a retraction of the piston can be repeated, wherein the front chamber has, in front of the front chamber, a front-chamber liner that is fitted to an inner surface of the cylinder, the front-chamber liner includes a front liner and a rear liner into which the front-chamber liner is halved in an axially front and rear direction, and the front liner is made of a copper alloy and functions as a bearing member configured to support sliding of the piston, and the rear liner is made of an alloy that has a higher mechanical strength than that of the front liner.

According to the hydraulic hammering device according to the second mode of the present invention, since the front-chamber liner in front of the front chamber is divided into a front liner on the front side and a rear liner on the rear side, the front liner is made of a copper alloy and works as a bearing member that supports sliding of the piston, the rear liner is made of an alloy having a higher mechanical strength than that of the front liner, it is possible to make the rear liner, which is made of an alloy having a higher mechanical strength than that of the front liner, cope with cavitation erosion and the front liner, which is made of copper alloy, function as a bearing function that slidingly supports the piston. Therefore, it is possible to maintain a function to slidingly support the piston, which is a function as a bearing required on the front chamber side to have, by the front liner, and, at the same time, to increase resistance to erosion by the rear liner on the front chamber side coping with shock pressure caused by the collapse of cavitation in the front chamber. Thus, it is possible to keep faults caused by cavitation erosion in the front chamber to a minimum.

Further, according to a result of an experimental study carried out by the inventors, it has been confirmed that cavitation erosion in the front chamber occurs in an unevenly distributed manner at the farthest side in the circumferential direction from the opening section of a front-chamber passage that supplies and discharges hydraulic oil to and from the front chamber.

Therefore, in the hydraulic hammering device according to the second mode of the present invention, it is preferable that the hydraulic hammering device have, on an inner surface of the cylinder, a front-chamber port that is formed in an annular shape in an opposing manner to an outer peripheral surface of a rear side portion of the front-chamber liner, a front-chamber passage that switches high and low pressure of hydraulic oil in the front chamber be connected to the front-chamber port so as to communicate therewith, the front-chamber liner be extended to a position opposing the front-chamber port, and, on a surface opposing the front-chamber port, a plurality of through holes separated from each other in the circumferential direction be formed in a penetrating manner in radial directions.

With such a configuration, since the front-chamber port formed into an annular shape is disposed on the interior surface of the cylinder, the front-chamber passage, which switches high and low pressure, is connected to the front-chamber port so as to communicate with the front-chamber port, and the rear liner is extended to a position opposing the front-chamber port and has a plurality of through holes separated from each other in the circumferential direction formed in a penetrating manner in radial directions on the surface opposing the front-chamber port, the plurality of through holes of the rear liner work as a region to disperse produced cavitation.

With this configuration, cavitation produced on the inner side of the front-chamber liner is dispersed by the plurality of through holes of the rear liner before entering the front-chamber port. Therefore, even when cavitation occurs, uneven distribution of cavitation to a portion on the side of the opening section of the front-chamber passage farthest from the opening section in the circumferential direction is relaxed. Therefore, convergent erosion occurring at the portion can be suppressed effectively. Further, since a rear side of the rear liner is extended to the rear of the front-chamber port, erosion can be prevented from occurring on a cylinder bore sliding surface. Therefore, wear-out parts due to erosion can be kept to a minimum.

Further, the inventors have acquired knowledge that, with respect to the problem of occurrences of cavitation in the above-described rapid variation in pressure and the above-described local occurrences of cavitation, by devising the shape and volume of the hydraulic chamber of the cushion chamber, it is possible to suppress occurrences of cavitation in the front chamber when the pressure of hydraulic oil is reduced as much as possible. Even if cavitation occurs to result in erosion, by causing erosion to occur at a location that does not influence sliding with the piston, it is possible to keep faults caused by cavitation erosion to a minimum and prevent being brought to a hammering-disabled state immediately.

Furthermore, in order to achieve the object mentioned above, according to a third mode of the present invention, there is provided a hydraulic hammering device including: a piston slidably fitted into a cylinder, the piston being configured to advance and retract to hammer a rod for hammering; a front chamber and a rear chamber that are defined between an outer peripheral surface of the piston and an inner peripheral surface of the cylinder and arranged separated from each other in the front and rear direction; and a switching valve mechanism configured to switch the front chamber into communication with a low pressure circuit when the piston advances and to supply and discharge hydraulic oil so that an advance and a retraction of the piston can be repeated, wherein the front chamber has a front-chamber liner that is fitted to an inner surface of the cylinder, a hydraulic chamber space is formed to the front-chamber liner as a cushion chamber, the hydraulic chamber space communicating with the front chamber to be filled with hydraulic oil, and the cushion chamber has a first ring section at a rear end section side of the cushion chamber and a second ring section that is formed in front of and adjacent to the first ring section and has a larger diameter than that of the first ring section.

According to the hydraulic hammering device according to the third mode of the present invention, since the cushion chamber has the first ring section at a rear end section side and the second ring section that is formed in front of and adjacent to the first ring section and has a larger diameter than that of the first ring section, expansion of volume because of the second ring section 52 formed in front of the first ring section enables the reduction in the pressure of hydraulic oil to be relaxed. Therefore, occurrences of cavitation in the front chamber 2 can be suppressed.

In the hydraulic hammering device according to the third mode of the present invention, it is preferable that an end face on the front side that forms the second ring section be formed into an orthogonal surface that is orthogonal to the axial direction. With such a configuration, even if cavitation occurs in the second ring section of the cushion chamber to result in erosion, since the end face forming the second ring section on the front side is formed into an orthogonal surface orthogonal to the axial direction, it is possible to confine the cavitation moving toward the front liner, which has a bearing function, within the second ring section using the orthogonal surface and cause erosion to occur at locations having no influence on sliding with the piston. Therefore, it is possible to keep faults caused by cavitation erosion to a minimum and prevent being brought to a hammering-disabled state immediately.

As described above, according to the present invention, it is possible to prevent or suppress occurrences of cavitation in a front chamber in a hydraulic hammering device employing a method that switches the front chamber into communication with a low pressure circuit when a piston advances.

BRIEF DESCRIPTION OF THE DRAWINGS

FIG. 5A illustrates a regular hammering position, FIG. 5B illustrates positions of the piston when the piston retracts in regular hammering, that is, the upper side of the center line and the lower side of the center line in the drawing illustrate a position when the piston decelerates in the retraction direction and a position when the piston has reached the back dead point, respectively, and FIG. 5C illustrates positions of the piston in a shank rod advanced state, that is, the upper side of the center line and the lower side of the center line in the drawing illustrate a position when the piston plunges into a cushion chamber and a position when the piston stops, respectively.

FIG. 6A illustrates an example in which no inner surface side annular groove is formed on the portion of the plurality of through holes, FIG. 6C is an arrow view taken in the direction of an arrow D in FIG. 6A, FIG. 6B illustrates an example in which an inner surface side annular groove is formed on the portion of the plurality of through holes, and FIG. 6D of the drawing is an arrow view taken in the direction of an arrow E in FIG. 6B.

DETAILED DESCRIPTION

Hereinafter, an embodiment of the present invention will be described with reference to the drawings as appropriate.

Figure 1:
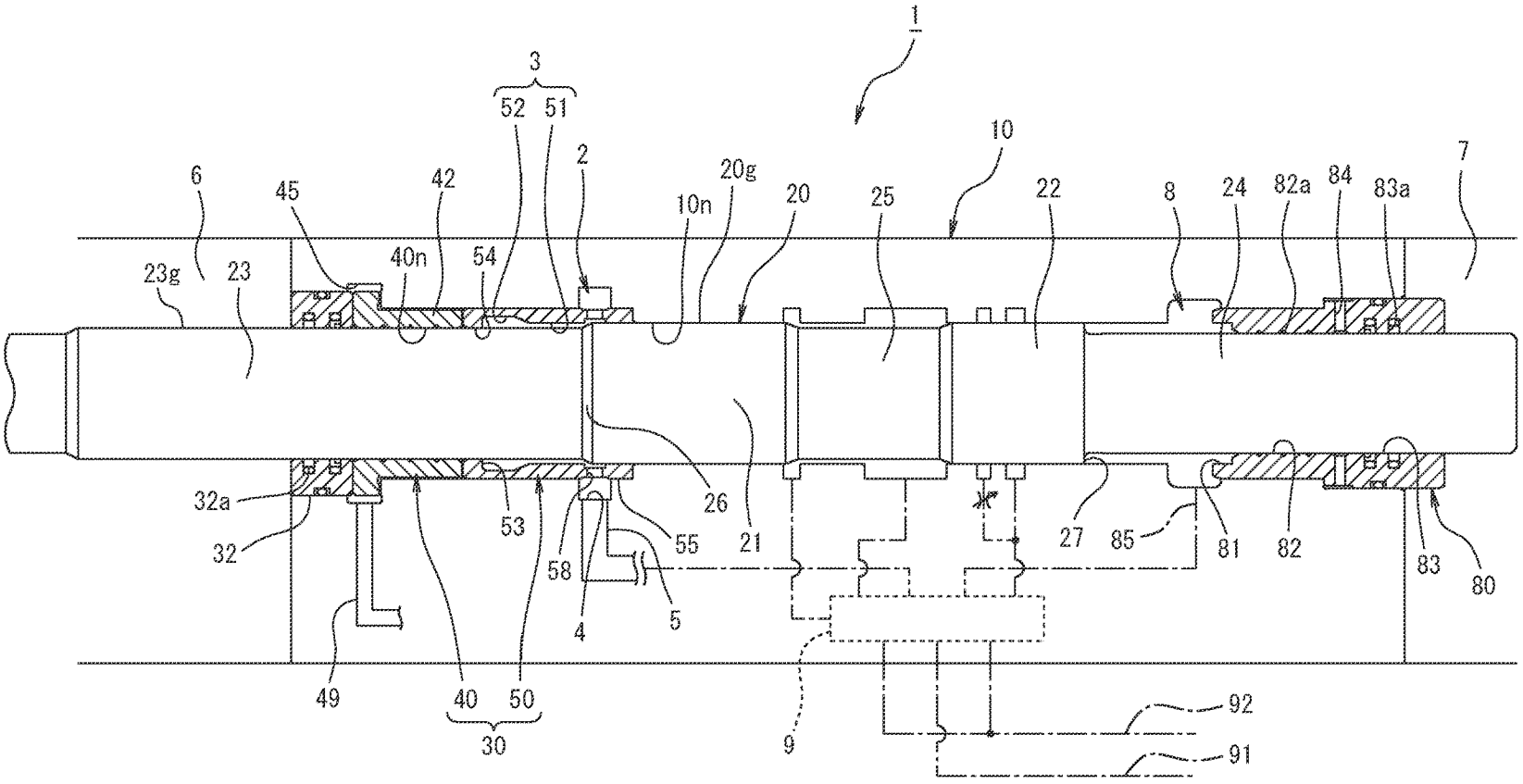
FIG. 1 is a cross-sectional view describing an embodiment of a hydraulic hammering device according to one mode of the present invention, and the drawing illustrates a cross-section along the axis.

A hydraulic hammering device 1 of the present embodiment is a hammering device that employs a "front/rear chamber alternate switching method", and, as illustrated in FIG. 1, a piston 20 is a solid cylindrical axial member and has large-diameter sections 21 and 22 in the axially middle thereof and small-diameter sections 23 and 24 formed in front and the rear of the large-diameter sections 21 and 22. The piston 20 being disposed in a cylinder 10 in a slidably fitted manner causes a front chamber 2 and a rear chamber 8 to be defined individually between an outer peripheral surface 20*g* of the piston 20 and an inner peripheral surface 10*n* of the cylinder 10. A step section at which the large-diameter section 21 and the small-diameter section 23 on the axially front side are connected to each other is a pressure receiving face on the front chamber 2 side to provide a thrust force in the directions of movement of the piston 20, and, in the present embodiment, the pressure receiving face on the front chamber 2 side is a conical surface 26 that reduces in diameter from the large-diameter section 21 side toward the small-diameter section 23 side. On the other hand, a step section at which the large-diameter section 22 and the small-diameter section 24 on the axially rear side are connected to each other is a pressure receiving face on the rear chamber 8 side, and, in the present embodiment, the pressure receiving face on the rear chamber 8 side is an orthogonal surface 27 that is an end face of the large-diameter section 22 orthogonal to the axial direction.

Between the large-diameter sections 21 and 22, a control groove 25 is formed into a depressed step section. The control groove 25 is connected to a switching valve mechanism 9 by way of a plurality of control ports. The front chamber 2 and the rear chamber 8 are connected to the switching valve mechanism 9 by way of high/low pressure switching ports 5 and 85 connected thereto, respectively. The switching valve mechanism 9 supplying and discharging hydraulic oil at predetermined timings to communicate each of the front chamber 2 and the rear chamber 8 with either a high pressure circuit 91 or a low pressure circuit 92 in an interchanging manner and the above-described pressure receiving faces being pressed by the oil pressure of hydraulic oil in the axial direction cause an advance and a retraction of the piston 20 to be repeated in the cylinder 10. In front and the rear of the cylinder 10, a front head 6 and a back head 7 corresponding to the type of the hammering device, such as a rock drill and a breaker, are attached, respectively.

The front chamber 2 has a front-chamber liner 30 disposed in front of the front chamber 2 and fitted to a cylinder inner peripheral surface 10*n*. In front of the front-chamber liner 30, an annular seal retainer 32 is fitted to the cylinder inner peripheral surface 10*n*. The seal retainer 32 has packing or the like fitted into a plurality of annular grooves 32*a* formed at appropriate positions on the inner and outer peripheral surface thereof and prevents hydraulic oil from leaking to the front further than the front chamber 2. The rear chamber 8 has a cylindrical rear-chamber liner 80 disposed in the rear of the rear chamber 8 and fitted to the cylinder inner peripheral surface 10*n*.

The rear-chamber liner 80 has, in order from the axially front, a rear-chamber defining section 81, a bearing section 82, and a seal retainer section 83 formed in one body. The above-described rear chamber 8 is defined by a cylindrical space on the inner periphery of a front side portion of the rear-chamber defining section 81 and a hydraulic chamber space between the inner peripheral surface of the cylinder 10 and the outer peripheral surface of the small-diameter section of the piston 20. The rear-chamber passage 85 is connected to the inner peripheral surface of the cylinder 10, which defines the rear chamber 8, in a communicating manner. The bearing section 82 is in sliding contact with the outer peripheral surface of the small-diameter section located at a rear side of the piston 20 and axially supports a rear section of the piston 20. On the inner peripheral surface of the bearing section 82, a plurality of annular oil grooves

82*a* are formed separated from each other in the axial direction to form a labyrinth. The seal retainer section 83 has packing or the like fitted to a plurality of annular grooves 83*a* formed at appropriate positions on the inner and outer peripheral surface thereof and prevents hydraulic oil from leaking to the rear further than the rear chamber 8. Between the bearing section 82 and the seal retainer section 83, communication holes 84 for draining are formed in a penetrating manner in radial directions, and the communication holes 84 are connected to a rear-chamber low pressure port (not illustrated).

The front-chamber liner 30 includes a set of a front liner 40 and a rear liner 50 located in axially front and rear. That is, in the present embodiment, the front-chamber liner 30 has an axially front side portion and an axially rear side portion divided into different liners. In the present embodiment, while no hydraulic chamber is formed to the front liner 40, a hydraulic chamber space is formed to only the rear liner 50, and a hydraulic chamber space formed to a rear section of the rear liner 50 in a communicated manner with the front chamber 2 forms a cushion chamber 3. To prevent the large-diameter section 21 of the piston 20 from striking against the cylinder 10 at the front stroke end of the piston, the cushion chamber 3, when the large-diameter section 21 of the piston 20 comes into the cushion chamber 3, changes the hydraulic chamber into a closed space to restrict the movement of the piston 20.

Figure 2:
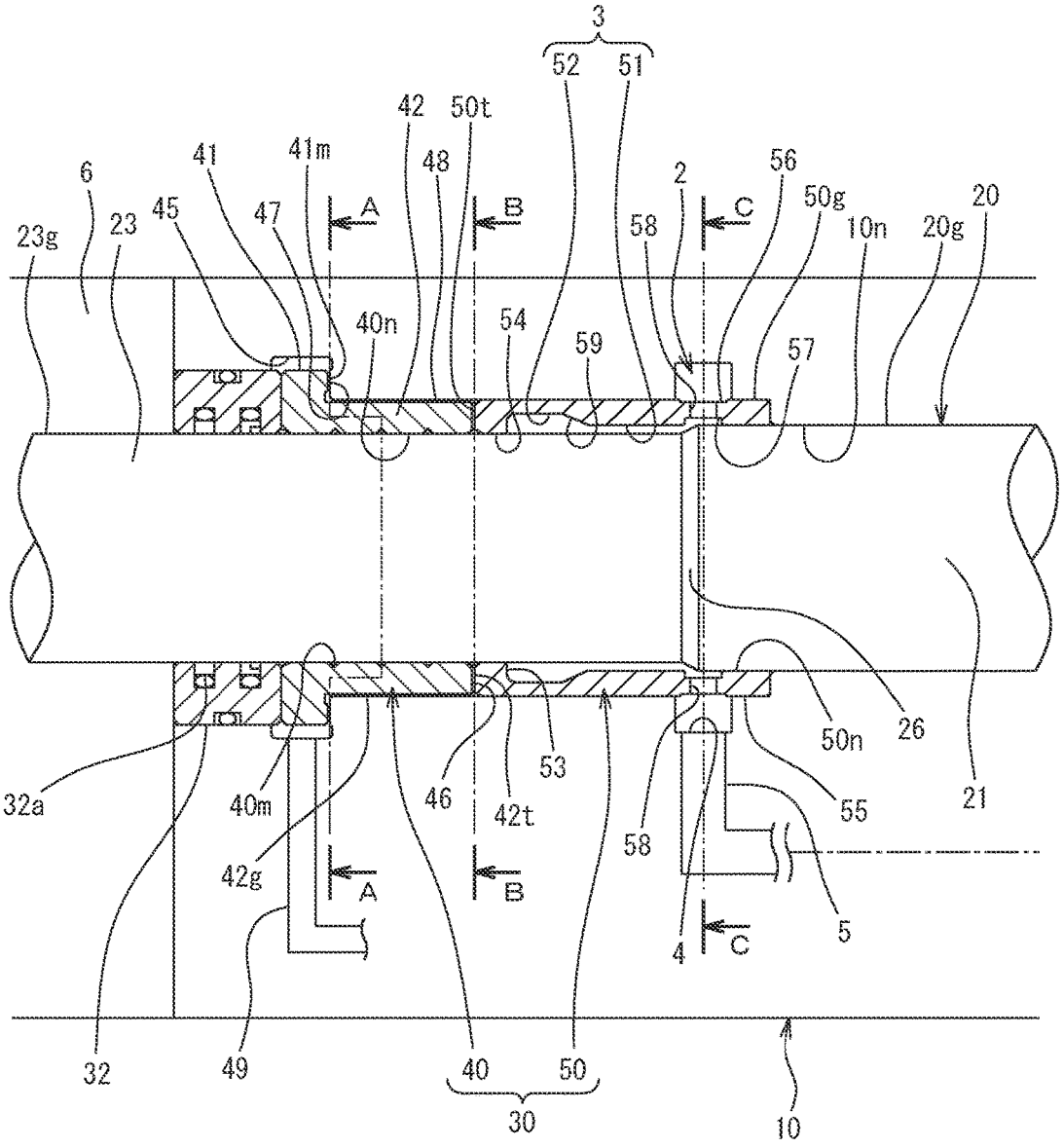
FIG. 2 is an enlarged view of a main portion (front-chamber liner portion) in FIG. 1.

Specifically, the above-described front liner 40 is made of a copper alloy and, as illustrated in an enlarged manner in FIG. 2, has, at a front side end section, a flange section 41 projecting in an annular manner toward the outside in the radial direction, and a rear portion behind the flange section 41 is formed into a cylindrical bearing section 42. Between the outer periphery of the flange section 41 and the inner peripheral surface of the cylinder 10, an annular drain port 45 is formed, and the drain port 45 is connected to a drain passage 49.

The front liner 40 is in sliding contact with an outer peripheral surface 23*g* of the small-diameter section 23 of the piston 20 with an opposing clearance narrower than a predetermined opposing clearance (clearance between the outer diameter of the piston 20 and the inner diameter of a liner) for a small-diameter section 54 that is a front end side inner periphery of the rear liner 50. On a sliding contact surface 40*n* of the inner periphery of the front liner 40, a plurality of annular oil grooves 40*m* are formed separated from each other in the axial direction to form a labyrinth. The front liner 40 has no hydraulic chamber space formed except the oil grooves 40*m* and works as a bearing that slidingly supports the piston 20.

A rear end face 42*t* of the front liner 40 is in contact with a front end face 50*t* of the rear liner 50, and, on the rear end face 42*t* of the front liner 40, a plurality of first end face grooves 46 are formed in radial directions separated from each other in the circumferential direction as radial communication passages. In this example, the plurality of first end face grooves 46 are arranged at equal intervals at four locations separated from each other in the circumferential direction (see FIG. 3B).

Further, the front liner 40 has, on an outer peripheral surface 42*g* of a cylindrical bearing section 42, a plurality of slits 48 formed in the axial direction at positions in alignment with the positions at which the above-described first end face grooves 46 are formed, as axial communication passages. In this example, the plurality of slit 48 are arranged at equal intervals at four locations in alignment with the positions at which the above-described first end face grooves 46 are formed (see FIG. 3A). Further, on the face of the flange section 41 of the front liner 40 that faces the rear side, a plurality of second end face grooves 47 are formed in radial directions at positions in alignment with the positions at which the plurality of slits 48 are formed as radial communication passages.

The plurality of second end face grooves 47 are in communication with the above-described drain port 45, which is formed on the outer periphery of the flange section 41 of the front liner 40. With this configuration, hydraulic oil in the cushion chamber 3 of the rear liner 50 can be led through a predetermined clearance at the small-diameter section 54 at a front end side of the rear liner 50 and, further, released to the drain passage 49 by way of "the first end face grooves 46 to the slits 48 to the second end face grooves 47 to the drain port 45".

In other words, the circuit is configured to function as a so-called "drain circuit". Since the circuit is formed separately from a drain circuit (hereinafter, also referred to as "first drain circuit") for pressurized oil that passes a liner bearing section (opposing clearance in radially inward and outward directions between the small-diameter section 23 of the piston 20 and the sliding contact surface 40*n* of the inner periphery of the front liner 40), the circuit can be referred to as "second drain circuit".

Communication holes including "the first end face grooves 46, the slits 48, and the second end face grooves 47" have respective passage areas of the first end face grooves 46, the slits 48, and the second end face grooves 47 set to a substantially identical area. While the present embodiment is an example in which communication holes are formed at four locations, the "total passage area of communication holes", obtained by adding together the passage areas of the plurality of communication holes, is set to an area within a predetermined range defined by the expression 1 below with respect to an "amount of clearance at a liner bearing section", and, with this configuration, the amount of leakage of pressurized oil from the "second drain circuit" is restricted to a predetermined amount. As used herein, the "amount of clearance at a liner bearing section" is an area of an annular clearance formed by the opposing clearance in radially inward and outward directions between the small-diameter section 23 of the piston 20 and the sliding contact surface 40*n* of the inner periphery of the front liner 40.

$$0.1Apf<A<2.5Apf \quad \text{(Expression 1)}$$

where Apf: an amount of clearance of a liner bearing section, and

A: the total passage area of communication holes.

The above-described rear liner 50 is made of an alloy that has a higher mechanical strength than that of the above-described front liner 40 made of a copper alloy. In the present embodiment, the mechanical strength of alloy steel is improved by heat treatment of alloy steel. For example, performing carburizing, quenching, and tempering to case-hardened steel enables a hardened layer to be formed on the surface thereof. The rear liner 50 has a cylindrical shape, the outer diameter dimension of which is set to the same dimension as that of the bearing section 42 of the above-described front liner 40. With regard to the inner diameter dimensions of the rear liner 50, the inner diameter dimension of a rear end side inner peripheral section 50*n* is set to the diameter of a sliding contact surface that is set apart from the large-diameter section 21 of the piston 20 by a slight clearance. On the other hand, the small-diameter section 54, which is the inner periphery of a front end side of the rear liner 50, has a dimension larger than the inner diameter dimension of the sliding contact surface 40*n* of the inner periphery of the front liner 40, and is set apart from the outer peripheral surface of the piston 20 by a predetermined opposing clearance larger than a clearance of the above-described liner bearing section.

Between an outer peripheral surface 50*g* of a rear side of the rear liner 50 and the inner peripheral surface of the cylinder 10, an annular front-chamber port 4 is formed, and, to the front-chamber port 4, a front-chamber passage 5 that switches high and low pressure in the front chamber 2 is connected. In other words, the rear liner 50 of the present embodiment has an extended section 55 that extends to the rear further than the front-chamber port 4.

In the present embodiment, the rear liner 50 has an outer surface side annular groove 56 formed at a position opposite to the front-chamber port 4 on the outer peripheral surface of the above-described extended section 55 and an inner surface side annular groove 57 formed on the inner peripheral surface of the extended section 55. In the annular grooves 56 and 57 on the outer and inner peripheral surfaces, a plurality of through holes 58 that are separated from each other in the circumferential direction are punched in radial directions.

Figure 3C:
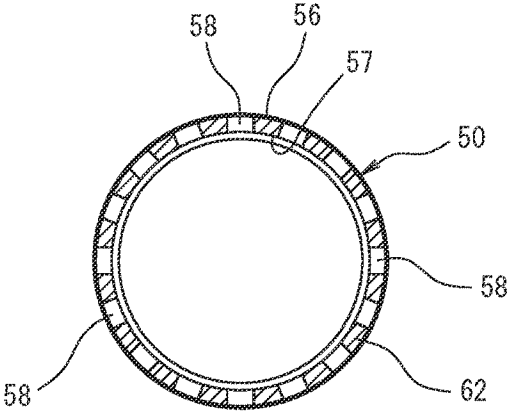
FIGS. 3A to 3C are cross-sectional views of a main portion of the front-chamber liner in FIG. 2, and FIGS. 3A, 3B, and 3C are a cross-sectional view taken along the line A-A, a cross-sectional view taken along the line B-B, and a cross-sectional view taken along the line C-C, respectively, in FIG. 2.
Figure 3B:
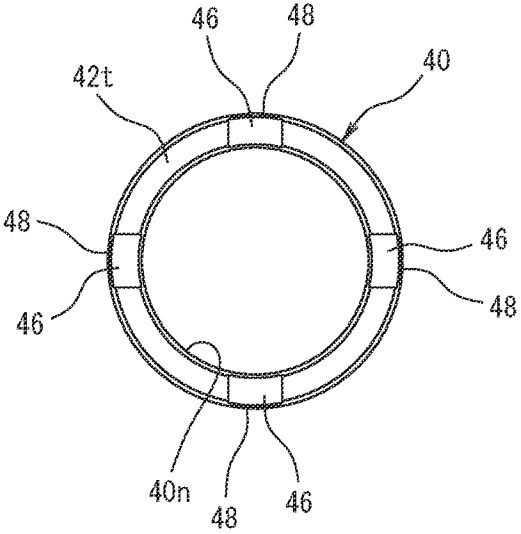
Figure 3A:
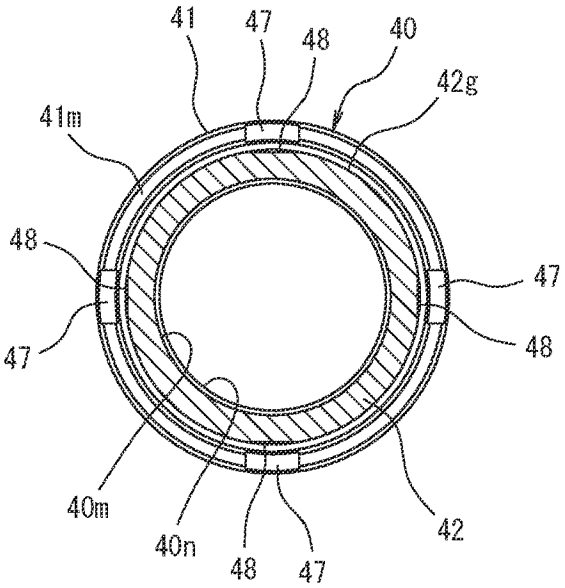
Figure 4A:
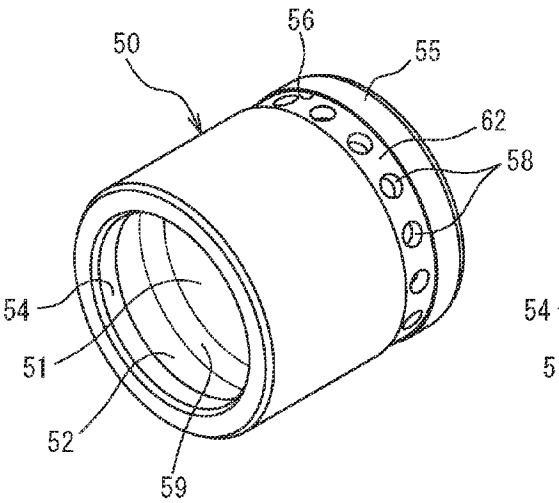
FIGS. 4A to 4C are perspective views of a rear liner included in the front-chamber liner in FIG. 2, and FIGS. 4A, 4B, and 4C illustrate a first example, a second example, and a third example, respectively, of the rear liner.
Figure 4B:
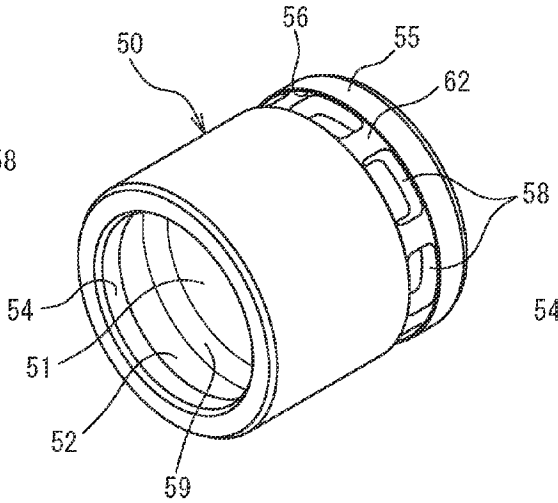

It is preferable that the plurality of through holes 58 be arranged at equal intervals in the circumferential direction (in the example illustrated in FIG. 3C, through holes 58 are arranged at equal intervals at 16 locations). Although the shapes of the plurality of through holes 58 are not limited to a specific shape, for example, circles (see FIG. 4A), or, as illustrated in FIG. 4B, rectangles (provided that the corners are rounded), ellipses, or the like may be applied to the shapes. It is preferable, to lower the flow velocity of hydraulic oil to reduce occurrences of cavitation, that the through holes 58 be formed into "slot shapes (elongated hole shapes)" each of which has a larger dimension in the circumferential direction than in the axial direction, such as a rectangle and an ellipse, because such shapes increase the passage areas of individual through holes 58.

Figure 4C:
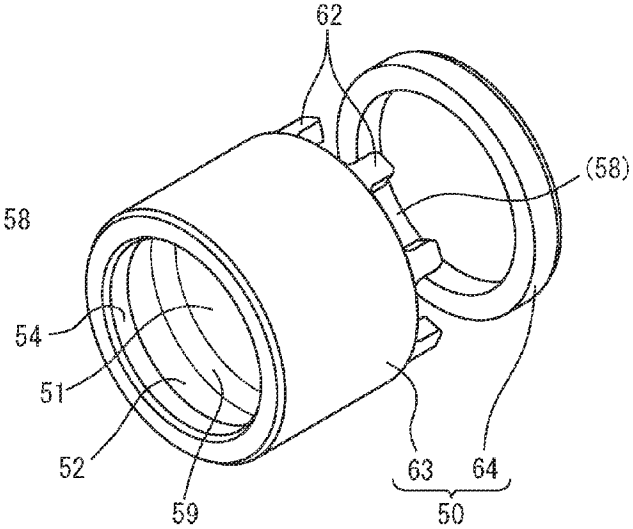

As illustrated in FIG. 4C, the rear liner 50 may also be formed into a divided structure. In the example illustrated in FIG. 4C, the rear liner 50 is formed into a structure that is dividable at a position along the rear side edge faces of the through holes 58, which have the "slot shapes" illustrated in FIG. 4B, into a rear liner (front) 63 and a rear liner (rear) 64, which compose the rear liner 50. The rear liner 50 being divided into two sections at the position causes pillar sections 62, which are formed between through holes 58 adjacent to each other in the circumferential direction, to be formed into cantilevers that project to the rear from the rear end of the rear liner (front) 63.

Further, as illustrated in FIG. 2, on the inner peripheral surface of a rear side of the rear liner 50, the above-described cushion chamber 3 is formed. In the present embodiment, the cushion chamber 3 has a first ring section 51 at an axially rear side thereof and a second ring section 52 formed in front of the first ring section 51. A portion at which the first ring section 51 and the second ring section 52 are connected to each other is formed into a conical surface 59 that expands in diameter from the first ring section 51 side toward the second ring section 52 side.

The axially rear of the first ring section 51 is in communication with the above-described inner surface side annular groove 57 over the entire circumference. The first ring section 51 has a shallower diameter (smaller diameter) than the depth (inner diameter) of the above-described inner surface side annular groove 57, and is formed with the rear thereof positioned in front of and adjacent to the inner surface side annular groove 57. The second ring section 52 has a larger diameter than that of the first ring section 51, and is formed with the rear thereof positioned in front of and adjacent to the first ring section 51. An end face on the front side that forms the second ring section 52 is formed into an orthogonal surface 53 that is orthogonal to the axial direction.

Figures 5A, 5B, 5C:
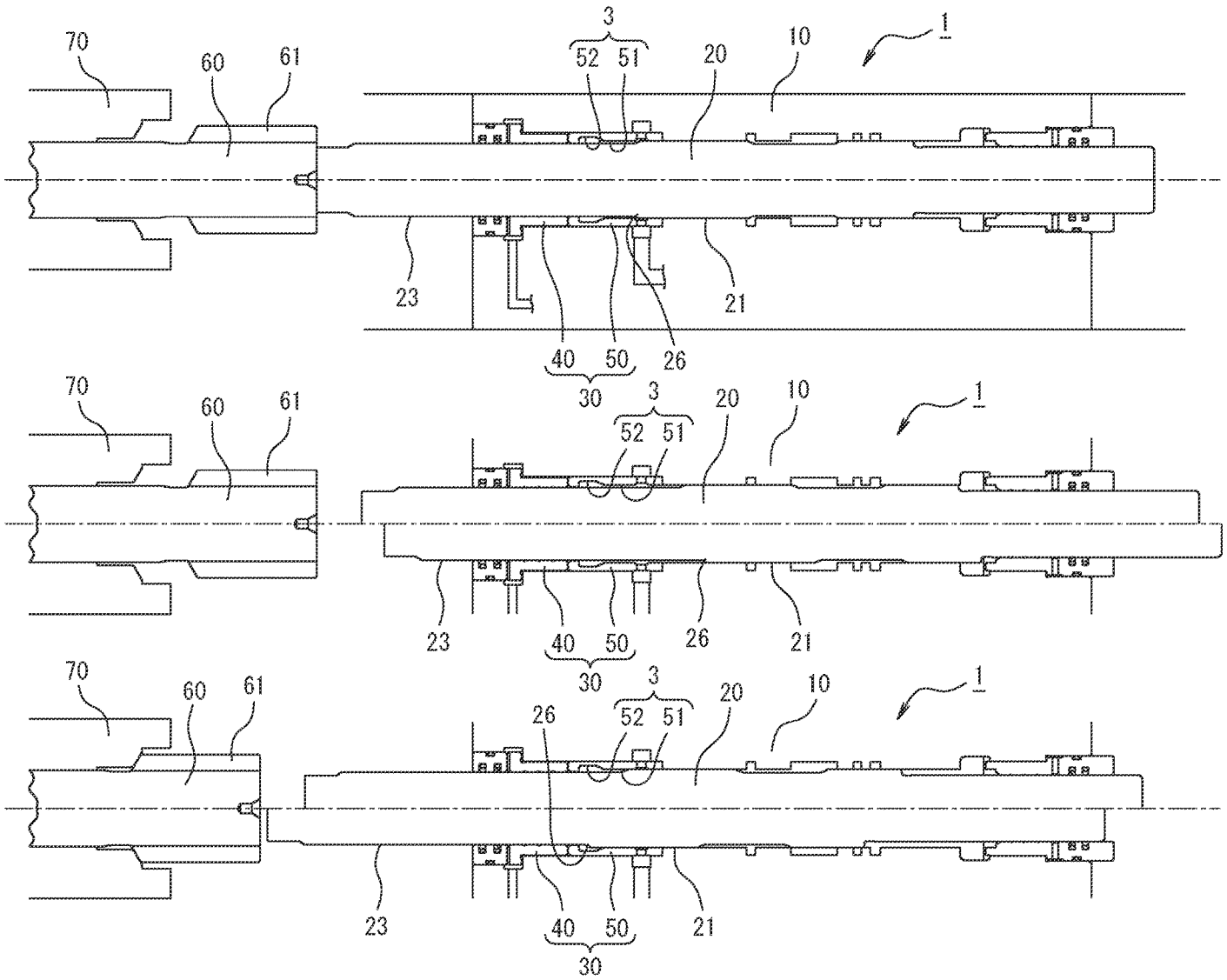
FIGS. 5A to 5C are longitudinal sectional views describing an operation of an embodiment of the hydraulic hammering device according to the one mode of the present invention, these drawings schematically illustrate an example of application of the present invention to a rock drill along with a shank rod portion, where

Next, an operation and operational effects of the hydraulic hammering device 1 will be described. In the following description, an example in which the hydraulic hammering device 1 of the present embodiment is applied to a rock drill will be described with reference to FIGS. 5A to 5C as appropriate. As illustrated in FIG. 5A, the rock drill has a shank rod 60 in front of the piston 20 of the above-described hydraulic hammering device 1. The shank rod 60 has splines 61 formed to a rear section thereof and is supported axially slidably within a predetermined range in a front cover 70. For the shank rod 60, a limit of movement to the rear side is restricted by a not-illustrated damper mechanism. The rock drill is provided with a not-illustrated feed mechanism and rotation mechanism, and the shank rod 60 is configured to be rotatable by the rotation mechanism that engages with the splines 61 and the cylinder 10 side of the hydraulic hammering device 1 is configured to be fed by the feed mechanism in accordance with the amount of crushing.

Regular hammering is performed at a rear limit of movement of the shank rod 60 when the hammering efficiency of the piston 20 is maximum, as illustrated in FIG. 5A. When the shank rod 60 is hammered by the piston 20, a shock wave produced by the hammering propagates from the shank rod 60 to a bit (not illustrated) at the tip through a rod and is used as energy for the bit to crush bedrock. The cylinder 10 side is fed by the not-illustrated feed mechanism in accordance with the amount of crushing. When hydraulic oil is supplied and discharged by the switching valve mechanism 9 of the above-described hydraulic hammering device 1 at an expected timing, the piston 20 is retracted in the cylinder 10, as illustrated in FIG. 5B, and decelerates at a predetermined position in the retracting direction, which is illustrated in the upper side of the center line in the drawing, and, thereafter, the piston 20 starts a movement in the advancing direction again at a back dead point, as illustrated in the lower side of the center line in the drawing.

In the hydraulic hammering device 1, the above-described switching valve mechanism 9 supplying and discharging hydraulic oil at expected timings causes each of the front chamber 2 and the rear chamber 8 to communicate with either the high pressure circuit 91 or the low pressure circuit 92 by way of the high and low pressure switching ports 5 and 85 in an interchanging manner and thereby an advance and a retraction of the piston 20 are repeated in the cylinder 10. That is, since the hydraulic hammering device 1 performs hammering in accordance with the "front/rear chamber alternate switching method", there is no occasion that hydraulic oil on the front chamber 2 side resists a movement of the piston in the hammering direction. Therefore, the hydraulic hammering device 1 is suitable to improve hammering efficiency.

When, during drilling, the bit does not reach rock normally due to plunging into a cavity zone, or the like, the shank rod 60 moves to the front further than a regular hammering position to cause a "shank rod advanced state", as illustrated in FIG. 5C. To prevent the large-diameter section 21 of the piston 20 from striking against the cylinder 10 at the front stroke end of the piston at this time, the cushion chamber 3 in communication with the front chamber 2 is provided. As illustrated in the upper side of the center line in FIG. 5C, the cushion chamber 3, when the large-diameter section 21 of the piston 20 comes into the cushion chamber 3, changes the hydraulic chamber into a closed space to restrict the movement of the piston. With this operation, as illustrated in the lower side of the center line in FIG. 5C, the end section of the large-diameter section 21 of the piston 20 (the position of the conical surface 26) is confined within the cushion chamber 3, and it is thus possible to prevent the large-diameter section 21 of the piston 20 from striking against the cylinder 10 at the front stroke end of the piston.

In a hydraulic hammering device employing a "front/rear chamber alternate switching method" of this type, a negative pressure state is caused to the hydraulic oil pressure in the front chamber to cause cavitation to easily occur. When the cushion chamber brakes the piston, pressurized oil is compressed in the cushion chamber to cause the cushion chamber to be brought to an ultrahigh pressure state. Thus, a rise in temperature of hydraulic oil caused by compression in the cushion chamber and the local production and compression of cavitation at a location where the flow velocity of pressurized oil is high becomes a problem. Further, there is another problem in that, since a decrease in the clearance between the piston and the front-chamber liner causes draining function to be reduced and the discharge of high-temperature pressurized oil to be suppressed, the rise in temperature is accelerated.

Figure 7:
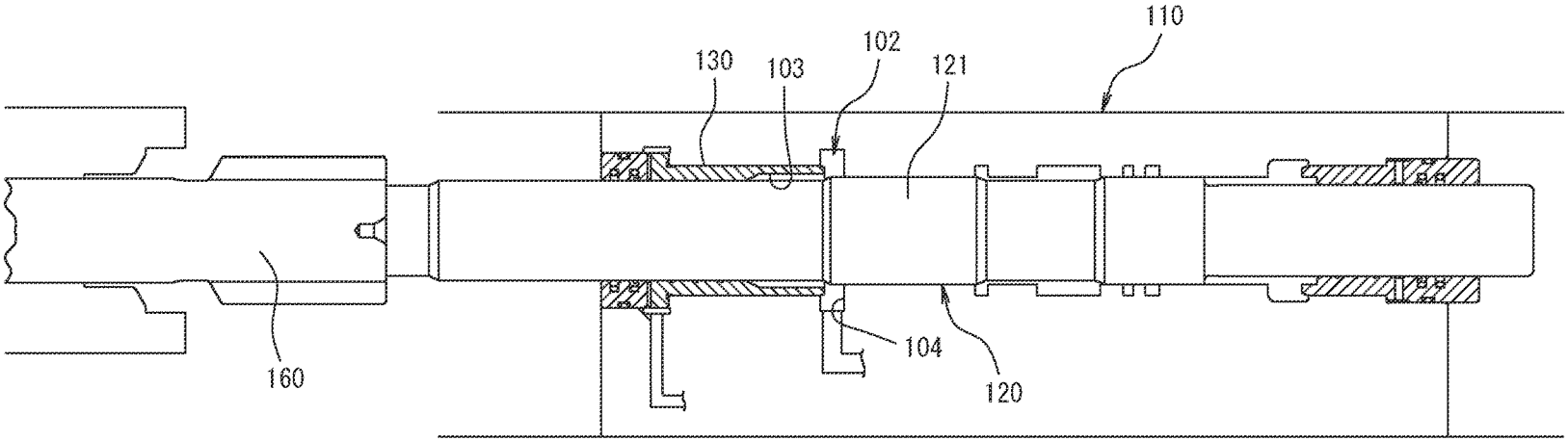
FIG. 7 is a diagram illustrating a comparative example for the hydraulic hammering device and the one embodiment thereof according to the one mode of the present invention, and the drawing is a longitudinal sectional view schematically illustrating an example of application of the comparative example to a rock drill along with a shank rod portion.

Specifically, a hydraulic hammering device employing the "front/rear chamber alternate switching method", such as a rock drill (drifter drill), is usually provided with a cushion chamber in the front chamber as a braking mechanism to prevent a large-diameter section of the piston from striking against the cylinder at the front stroke end of the piston. A comparative example for the present embodiment is illustrated in FIG. 7.

In the comparative example illustrated in the drawing, a shank rod 160 is arranged in front of a piston 120. To a front side of the inside of a cylinder 110, an annular front-chamber port 104 is formed, and, in front of the front-chamber port 104, a front-chamber liner 130 that is made of a copper alloy and formed in a monolithic structure is fitted to the inner surface of the cylinder 110. To a rear section of the front-chamber liner 130, a hydraulic chamber space that is filled with hydraulic oil is defined, and the hydraulic chamber space forms a cushion chamber 103 that communicates with a front chamber 102.

The piston 120 hammers the rear end of the shank rod 160 when hammering efficiency is maximum. When the shank rod 160 is hammered by the piston 120, a shock wave produced by the hammering propagates to a bit (not illustrated) at the tip through a rod disposed on the tip side of the shank rod 160 and is used as energy for drilling.

When, during drilling, the bit does not reach rock normally due to plunging into a cavity zone, or the like, a state in which the bit, the rod, and the shank rod 160, which are fastened with each other by screws, project relatively to the front with respect to the main body of the rock drill (a state in which the shank rod 160 has advanced further than a regular hammering position) is caused (hereinafter, also referred to as "shank rod advanced state"). If the piston 120 operates in the "shank rod advanced state", a large-diameter section 121 of the piston 120 comes into the cushion chamber 103 to be braked therein. Thus, pressurized oil is compressed in the cushion chamber 103, and the inside thereof is brought to an ultrahigh pressure state.

Therefore, in the cushion chamber 103, compression causes the oil temperature of hydraulic oil to rise. Further, when pressure inside the cushion chamber 103 becomes ultrahigh, the outflow velocity of pressurized oil from the cushion chamber 103 to the front chamber 102 side becomes excessive. Thus, cavitation is produced locally at a location where the flow velocity of pressurized oil is high, and, subsequently, due to the front chamber 102 turning to high pressure, the produced cavitation is compressed and heat is thereby generated, causing the oil temperature to further rise. Due to the rise in oil temperature, the copper alloy portion of the front-chamber liner 130 expands and reduces in diameter, causing a possibility that so-called "galling" occurs at a location where the front-chamber liner 130 is in sliding contact with the piston 120. Since oil temperature rises in proportion to the amount of advancing movement of the piston 120 in the front chamber 102 and the cushion chamber 103, the rise in oil temperature reaches a maximum when the shank rod 160 has moved to the front end of a stroke thereof.

As described in the comparative example, for a hydraulic hammering device employing the "front/rear chamber alternate switching method", there is a problem in that a rise in temperature of hydraulic oil due to local occurrence and compression of cavitation causes "galling" to easily occur. In particular, the risk of occurrence of "galling" tends to increase as the number of strikes increases. Further, there is another problem in that a decrease in clearance between the piston and the front-chamber liner causes a draining function to be reduced and the discharge of high-temperature pressurized oil to be suppressed to accelerate the rise in temperature.

On the other hand, according to the hydraulic hammering device 1 of the present embodiment, the cushion chamber 3, by the above-described "second drain circuit", always communicate hydraulic oil in the cushion chamber 3 with a low pressure circuit by way of passages that are composed of "the first end face grooves 46, the slits 48, and the second end face grooves 47" as one or more communication holes that go(es) through locations other than the liner bearing section. That is, since the cushion chamber 3 has the "second drain circuit", which is formed separately from the drain circuit that guides hydraulic oil to pass the above-described liner bearing section of the front-chamber liner 30 to the drain passage 49, which is a low pressure circuit, hydraulic oil that flows out of the cushion chamber 3 in the front-chamber liner 30 can be released by way of the "second drain circuit" when pressurized oil is compressed to be brought to an ultrahigh pressure state in the cushion chamber 3.

With this configuration, since compression in the cushion chamber 3 is relaxed compared with a case in which the "second drain circuit" is not provided, a rise in oil temperature of hydraulic oil is also suppressed. Further, since the flow velocity of hydraulic oil that flows into the front chamber 2 is reduced, local occurrences of cavitation are suppressed. Although the front chamber 2 is subsequently switched to high pressure by the switching valve mechanism 9, the suppressed cavitation enables heat generation due to the compression of cavitation to be relaxed and a rise in temperature of hydraulic oil to be reduced substantially.

Therefore, expansion of a copper alloy portion of the front-chamber liner 30 (in the present embodiment, the front liner 40 composing the front-chamber liner 30) due to the rise in temperature of hydraulic oil is also relaxed, enabling occurrences of "galling" to the piston 20 at sliding contact portions with the front-chamber liner 30 to be reduced. While the passage area of the above-described "first drain circuit" decreases rapidly due to expansion caused by a rise in temperature, the passage area of the "second drain circuit" is insusceptible to a rise in temperature.

Further, when focusing on piston movements when the piston 20 advances to the front end of a stroke and stops there in the cushion chamber 3, while pressurized oil supplied to the front chamber 2 by valve switching is supplied into the cushion chamber 3 through the clearance between the inner periphery of the rear liner 50 and the large-diameter section 21 of the piston 20 and the piston 20 turns to retraction, at this time, a portion of the pressurized oil is released by way of the "second drain circuit", causing an increase in pressure inside the cushion chamber 3 to be gradual. Thus, the retraction speed of the piston 20 is slowed down and the number of strikes per unit time when in the "shank rod advanced state" is reduced, causing a rise in oil temperature in the front chamber 2 to be relaxed.

In the present embodiment, since the total passage area of the passage composed of "the first end face grooves 46, the slits 48, and the second end face grooves 47" as a plurality of communication holes is set to an area within a predetermined range defined by the above-described expression 1 with respect to the above-described amount of clearance at the liner bearing section, it is possible to, while preventing a decrease in hammering efficiency in regular hammering as much as possible, suppress a rise in oil temperature when pressurized oil is compressed to be brought to an ultrahigh pressure state in the cushion chamber, such as when in the "shank rod advanced state".

Further, since the second drain circuit of the present embodiment always communicates the hydraulic oil in the cushion chamber 3 with the drain passage 49, which is a low pressure circuit, by way of the first end face grooves 46, which are radial communication passages, the slits 48, which are axial communication passages, and the drain port 45 in this order, no low pressure port dedicated for the "second drain circuit" is required. Thus, it is possible to form the "second drain circuit" while simplifying the structure thereof.

In the hydraulic hammering device employing the "front/rear chamber alternate switching method", a rapid variation in the pressure of hydraulic oil is caused in the front chamber in a regular hammering phase, in which the piston transitions from a hammering step in which the piston advances to a retraction step in which the piston is reversed to retraction. Such a problem of pressure variation of hydraulic oil in the front chamber does not become a significant problem for a hydraulic hammering device employing a "rear chamber alternate switching method" because the front chamber is always in communication with a high pressure circuit. On the other hand, in the hydraulic hammering device employing the "front/rear chamber alternate switching method", cavitation becomes likely to occur because a negative pressure state is caused. Erosion caused by shock pressure due to the collapse of cavitation also becomes likely to occur.

That is, in, for example, a rock drill (drifter drill), a shank rod is arranged in front of the piston and the piston is configured to advance to hammer the rear end of the shank rod. In the hydraulic hammering device employing the "front/rear chamber alternate switching method", while, in the hammering phase, the front chamber is communicated with a low pressure circuit, a rapid braking is exerted on the piston when the piston hammers a shank rod. At this time, since hydraulic oil continues flowing out due to inertia even when the piston is rapidly braked, a negative pressure state is caused in the front chamber. Thus, when the pressure of hydraulic oil becomes lower than a saturated vapor pressure for only a very short period of time, cavitation becomes likely to occur. When the piston transitions to the retraction step after hammering, the front chamber is communicated with a high pressure circuit by a switching valve mechanism. Therefore, there is a problem in that erosion is likely to occur in the front chamber due to shock pressure caused by produced cavitation being compressed to collapse.

On the other hand, according to the hydraulic hammering device 1 of the present embodiment, since the cushion chamber 3 has the first ring section 51 at a rear end section side and the second ring section 52 that is formed in front of and adjacent to the first ring section 51 and has a larger diameter than that of the first ring section 51, expansion of volume because of the second ring section 52 formed in front of the first ring section 51 enables a reduction in the pressure of hydraulic oil to be relaxed. Therefore, occurrences of cavitation in the front chamber 2 can be suppressed. Even when cavitation occurs, the cavitation collapsing to cause erosion can be suppressed. Thus, the hydraulic hammering device 1 of the present embodiment is more suitable to suppress a rise in oil temperature.

Further, since the cushion chamber 3 has an end face that forms the second ring section 52 on the front side formed into the orthogonal surface 53 that is orthogonal to the axial direction, even if cavitation occurs in the second ring section 52 of the cushion chamber 3 to result in erosion, it is possible to confine the cavitation moving toward the front liner 40, which has a bearing function, within the cushion chamber 3 using the orthogonal surface 53 and cause erosion to occur at locations having no influence on sliding with the piston. Therefore, it is possible to keep faults caused by cavitation erosion to a minimum and prevent being brought to a hammering-disabled state immediately.

Further, according to the hydraulic hammering device 1 of the present embodiment, since the front-chamber liner 30 includes the front liner 40 and the rear liner 50, into which the front-chamber liner 30 is halved in the axially front and rear direction, the front liner 40 is made of a copper alloy and, due to having no hydraulic chamber space formed except the oil grooves 40*m*, works as a bearing member that supports sliding of the piston 20, and the rear liner 50 is made of alloy steel with a hardened layer formed on the surface thereof and has a hydraulic chamber space formed as the cushion chamber 3 that is in communication with the front chamber 2 and is filled with hydraulic oil, it is possible to make the interior wall surface of a hydraulic chamber space formed by the cushion chamber 3 in the rear liner 50, which is made of alloy steel having a high hardness, cope with cavitation erosion and the front liner 40, which is made of a copper alloy and has no hydraulic chamber space formed, function as a bearing that slidingly supports the piston 20.

Therefore, it is possible to maintain a function to slidingly support the piston, which is a function as a bearing required for the front chamber 2 side to have, by the front liner 40 and, at the same time, to increase resistance to erosion by the rear liner 50 coping with shock pressure caused by the collapse of cavitation in the front chamber 2. Thus, it is possible to keep faults caused by cavitation erosion to a minimum.

Further, according to a result of an experimental study carried out by the inventors, it has been confirmed that, in a hydraulic hammering device employing the "front/rear chamber alternate switching method", cavitation erosion in the front chamber occurs in an unevenly distributed manner at the farthest side in the circumferential direction from the opening section of a high/low pressure switching port that supplies and discharges hydraulic oil to and from the front chamber.

On the other hand, according to the hydraulic hammering device 1 of the present embodiment, since the front-chamber port 4 formed into an annular shape is disposed on the interior surface of the cylinder 10, the front-chamber passage 5, which switches high and low pressure, is connected to the front-chamber port 4 so as to communicate with the front-chamber port 4, and the rear liner 50 included in the front-chamber liner 30 is extended to a position opposing the front-chamber port 4 and has a plurality of through holes 58 separated from each other in the circumferential direction formed in a penetrating manner in radial directions on the surface opposing the front-chamber port 4, the plurality of through holes 58 work as a region to disperse produced cavitation.

With this configuration, cavitation produced on the inner side of the rear liner 50 included in the front-chamber liner 30 is dispersed by the plurality of through holes 58 formed to the rear liner 50 before entering the front-chamber port 4. Therefore, even when cavitation occurs, uneven distribution of cavitation to the farthest side in the circumferential direction from the opening section of the front-chamber passage 5 is relaxed. Therefore, convergent erosion occurring at the portion can be suppressed effectively.

Further, since a rear side of the rear liner is extended to the rear of the front-chamber port, erosion can be prevented from occurring on a cylinder bore sliding surface. Therefore, wear-out parts due to erosion can be kept to a minimum.

Further, in the present embodiment, since the plurality of through holes 58 are formed in the inner surface side annular groove 57, which is formed on the inner peripheral surface of the extended section 55, and the axially rear of the above-described first ring section 51 is in communication with the inner surface side annular groove 57 over the entire circumference, it is possible to prevent hammering efficiency from being reduced by making a cushioning effect by the cushion chamber 3 start to take effect at an expected position.

Figure 6A:
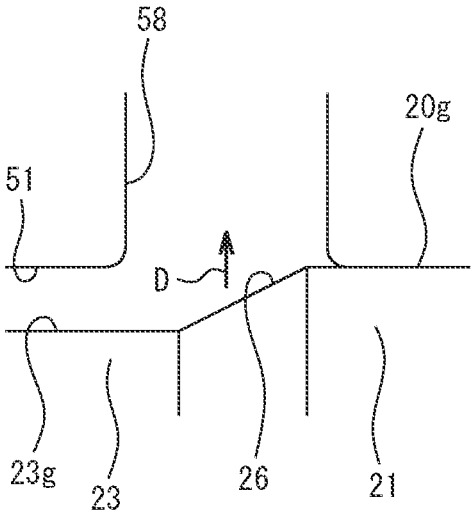
FIGS. 6A to 6C are schematic views describing an operational effect of a portion of a plurality of through holes formed in the rear liner, where

That is, if, as illustrated in FIG. 6A, the inner surface side annular groove 57 is not formed to opening portions of the plurality of through holes 58, the large-diameter section 21 of the piston 20 passes the opening portions of the through holes 58 directly in sliding contact therewith. Thus, when the large-diameter section 21 of the piston 20 passes the opening portions of the through holes 58, as illustrated in FIG. 6C, variation in the passage area of passages through which pressurized oil flows out to the low pressure side (the front-chamber port 4 side) becomes large (the two-dot chain lines in the drawing illustrate an image of a process in which the ridgeline of the end section of the large-diameter section passes an opening portion of a through hole 58). Therefore, a cushioning effect starts to take effect earlier than the time at which the large-diameter section 21 plunges into the cushion chamber 3, causing hammering efficiency to be reduced.

Figure 6B:
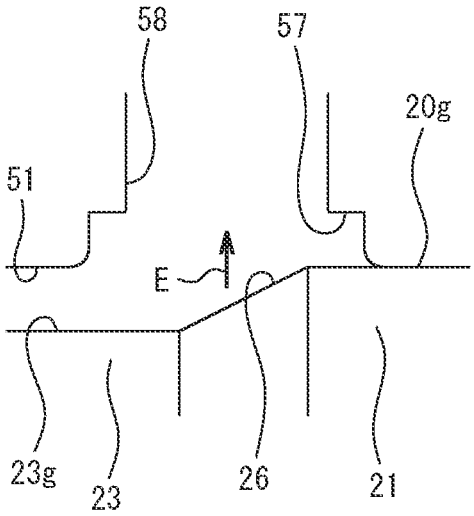
Figure 6C:
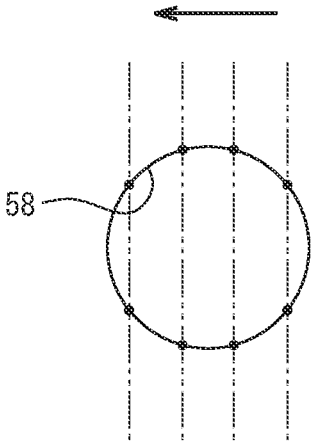
Figure 6D:
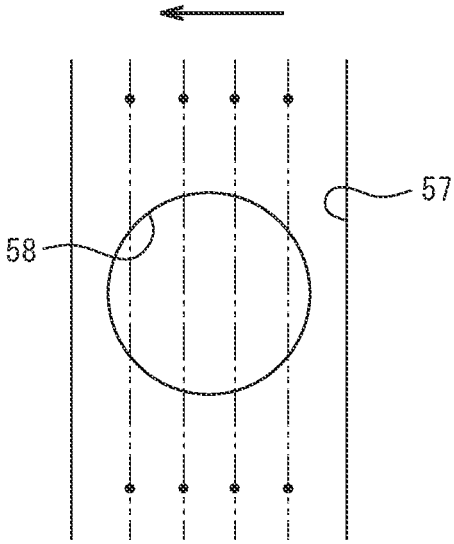

On the other hand, when, as illustrated in FIG. 6B, the inner surface side annular groove 57 is formed as in the present embodiment, the large-diameter section 21 of the piston 20 passing the opening portions of the through holes 58 with the inner surface side annular groove 57 interposed therebetween enables the rate of variation in the passage area of passages through which pressurized oil flows out to the low pressure side to be kept constant, as FIG. 6D illustrates an image of the passing process by the two-dot chain lines. In consequence, a cushioning effect is prevented from taking effect earlier than the time at which the large-diameter section 21 plunges into the cushion chamber 3, and it is possible to make an expected cushioning effect start to take effect from an expected position, that is, the rear end position of the first ring section 51 that continues from the front side end section of the inner surface side annular groove 57.

It is preferable to form a plurality of pillar sections 62 formed between through holes 58 that are adjacent to each other in the circumferential direction into cantilevers. In this case, it is preferable to divide the rear liner 50 at a position along the rear side edge faces of the through holes 58 formed into "slot shapes" into the rear liner (front) 63 and the rear liner (rear) 64, which compose the rear liner 50, as in a third example illustrated in FIG. 4C.

That is, when surge pressure is produced in association with advancing and retracting movements of the piston 20, pillar sections having a both-ends supported structure as illustrated in FIG. 4B cause the produced surge pressure to be exerted to the pillar sections as tensile pressure in the longitudinal directions. Thus, there is a possibility that, when erosion progresses in the vicinity of the pillar sections, the pillar sections becomes unable to withstand the tensile pressure to be broken. On the other hand, when, as illustrated in FIG. 4C, the plurality of pillar sections 62 are formed into cantilevers, tensile pressure caused by surge pressure is not exerted to the pillar sections 62. Therefore, the breaking up of the pillar sections 62 due to surge pressure can be prevented or suppressed.

As described thus far, by use of the hydraulic hammering device, cavitation in the front chamber can be prevented or suppressed. It is possible to suppress a rise in oil temperature in the front chamber and to reduce occurrences of "galling" to the piston at sliding contact locations with the front-chamber liner. Further, it is possible to prevent or suppress cavitation erosion in the front chamber effectively or to keep faults caused by cavitation erosion to a minimum. The hydraulic hammering device according to the present invention is not limited to the above-described embodiment, and it should be understood that various modifications can be made without departing from the spirit and scope of the present invention.

For example, although the hydraulic hammering device 1 of the above-described embodiment was described using a hammering device employing the "front/rear chamber alternate switching method" as an example, without being limited to the embodiment, the present invention can be applied to a hydraulic hammering device employing a method in which a front chamber is switched to a low pressure circuit when the piston advances. For example, the present invention can also be applied to a hammering device employing a "front chamber alternate switching method" as disclosed in JP 05-039877 U.

That is, in a hammering device employing the "front chamber alternate switching method", while a rear chamber is always communicated with a high pressure circuit, a front chamber is communicated with either the high pressure circuit or a low pressure circuit alternately by a switching valve mechanism. Front and rear pressure receiving areas are differentiated from each other so that the piston can move in the retracting direction when the front chamber is in communication with the high pressure circuit, and, with this configuration, advancing and retracting movements of the piston are repeated in the cylinder. Thus, since the method in which the front chamber is switched to the low pressure circuit when the piston advances causes pressure in the front chamber to become low when the piston advances, a problem of preventing occurrences of galling to the piston caused by a rise in oil temperature in the front chamber, or the like, is caused in the same mechanism of action, and, thus, the present invention can be applied.

Although the above-described embodiment was, for example, described using an example in which the front-chamber liner 30 is composed of the front liner 40 and the rear liner 50, into which the front-chamber liner 30 is halved in the axially front and rear direction, without limited to the example, as in the mode illustrated in the comparative example in FIGS. 5A to 5C, the front-chamber liner 30 may be composed of a liner having a monolithic structure.

However, to maintain a function to slidingly support the piston, which is a function as a bearing required for the front chamber 2 side to have, by the front liner 40 and, at the same time, to increase resistance to erosion by the rear liner 50 coping with shock pressure caused by the collapse of cavitation in the front chamber 2, it is preferable that, as in the above-described embodiment, the front-chamber liner 30 be composed of the front liner 40 and the rear liner 50, into which the front-chamber liner 30 is halved in the axially front and rear direction, and the rear liner 50 be made of an alloy that has a higher mechanical strength than that of the front liner 40.

In the case of the front-chamber liner 30 being composed of the halved front liner 40 and rear liner 50, although an example in which the rear liner 50 is made of "case-hardened steel", which has a hardened layer formed on the surface thereof by performing carburizing, quenching, and tempering, was described in the above-described embodiment, the rear liner 50 may be made of any alloy that has a higher mechanical strength than that of the front liner 40.

For example, to improve mechanical strength, various hardening treatment, such as heat treatment, physical treatment, and chemical treatment, may be employed. With regard to materials, in addition to, for example, chrome steel, chromium-molybdenum steel, nickel-chromium steel, and so on, various alloy steel for mechanical structures may be employed. Mechanical strength may be raised by not only forming a hardened layer on the surface but also hardening the whole using alloy tool steel, such as SKD, and there is no limitation to whether or not applying hardening treatment, and an alloy, such as Stellite (trademark), may be used.

Although the above-described embodiment was, for example, described using an example in which the rear liner 50 is extended to a position opposing the front-chamber port 4 and has a plurality of through holes 58 separated from each other in the circumferential direction punched in a penetrating manner in radial directions on the surface opposing the front-chamber port 4, without being limited to the example, the length of the front-chamber liner 30 (rear liner 50) may be set to such a length that the rear end section thereof does not extend to the rear further than the position of the front end of the front-chamber port 4, as in the mode illustrated in the comparative example in FIG. 7.

However, to more suitably relax uneven distribution of cavitation to a portion on the side farthest from the opening section of the front-chamber passage 5 in the circumferential direction, it is preferable to extend the rear liner 50 to a position opposing the front-chamber port 4 and form a plurality of through holes 58 separated from each other in the circumferential direction in a penetrating manner in radial directions on the surface opposing the front-chamber port 4. Further, to prevent occurrences of erosion on the inner periphery of the cylinder 10, it is also preferable to extend the rear liner 50 to the rear side of the front-chamber port 4.

Although the above-described embodiment was, for example, described using an example in which, as the "second drain circuit", the first end face grooves 46 are formed in radial directions separated from each other in the circumferential direction on a boundary section between the front liner 40 and the rear liner 50, which is positioned anterior to the cushion chamber 3, and a plurality of communication holes including "the first end face grooves 46, the slits 48, and the second end face grooves 47", are always in communication with a low pressure circuit, the configuration is not limited to the example.

For example, as long as the "second drain circuit" is formed separately from the "first drain circuit" for the pressurized oil passing the liner bearing section and passes through portions other than the liner bearing section to communicate with the cushion chamber 3, various modifications can be applied thereto. Although it is preferable that the "second drain circuit" have the plurality of communication holes disposed at a position anterior to the cushion chamber 3, the position at which the plurality of communication holes are formed is not limited to the boundary section between the front liner 40 and the rear liner 50. The same applies to not only the case in which the front-chamber liner 30 is composed of a liner having a monolithic structure but also the case in which the front-chamber liner 30 is composed of the front liner 40 and the rear liner 50.

However, in the case in which the front-chamber liner 30 is composed of the front liner 40 and the rear liner 50, to suppress a rise in oil temperature in the cushion chamber 3 and reduce occurrences of "galling" to the piston 20 at sliding contact locations with the front-chamber liner 30, it is preferable that the "second drain circuit" be configured such that, on the boundary section between the front liner 40 and the rear liner 50, a plurality of radial communication passages formed in a penetrating manner in radial directions separated from each other in the circumferential direction are formed, and the plurality of radial communication passages are always in communication with a low pressure circuit.

Although the above-described embodiment was, for example, described using an example in which, with regard to the shape and volume of the hydraulic chamber of the cushion chamber 3, the cushion chamber 3 includes the first ring section 51 and the second ring section 52, which has a larger diameter than that of the first ring section 51, and, further, the front side end face forming the second ring section 52 is formed into the orthogonal surface 53, which is orthogonal to the axial direction, without being limited to the example, the hydraulic chamber shape of the cushion chamber 3 may be composed of only one annular section, as in, for example, the mode illustrated in the comparative example in FIG. 7.

However, to more suitably suppress occurrences of cavitation in the front chamber 2 when the pressure of hydraulic oil is reduced, it is preferable that the cushion chamber 3 includes the first ring section 51 and the second ring section 52, which is formed in front of the first ring section 51 and has a large volume. The front side end face that forms the second ring section 52 may be formed into an inclined plane, as in, for example, the mode illustrated in the comparative example in FIG. 7. However, to more suitably suppress cavitation moving toward the front liner 40, which has a bearing function, it is preferable to form the front side end face that forms the second ring section 52 into the orthogonal surface 53 that is orthogonal to the axial direction.

A list of the reference numbers in the drawings is described below.

1 Hydraulic hammering device
2 Front chamber
3 Cushion chamber
4 Front-chamber port
5 Front-chamber passage
6 Front head
7 Back head
8 Rear chamber
9 Switching valve mechanism
10 Cylinder
20 Piston
21, 22 Large-diameter section
23, 24 Small-diameter section
25 Control groove
26 Conical surface
27 Orthogonal surface
30 Front-chamber liner
32 Seal retainer
40 Front liner
41 Flange section
42 Bearing section
45 Drain port
46 First end face groove (first radial communication passage)
47 Second end face groove (second radial communication passage)
48 Slit (axial communication passage)
49 Drain passage
50 Rear liner
51 First ring section
52 Second ring section
53 Orthogonal surface
54 Small-diameter section
55 Extended section
56 Outer surface side annular groove
57 Inner surface side annular groove
58 Through hole
59 Conical surface
62 Pillar section
63 Rear liner (front)
64 Rear liner (rear)
80 Rear chamber liner
81 Rear chamber defining section
82 Bearing section
83 Seal retainer section
84 Communication hole for draining
85 Rear chamber passage
91 High pressure circuit
92 Low pressure circuit

The invention claimed is:

1. A hydraulic hammering device comprising:

a piston slidably fitted into a cylinder, the piston being configured to advance and retract to hammer a rod for hammering;

a front chamber and a rear chamber that are defined between an outer peripheral surface of the piston and an inner peripheral surface of the cylinder and arranged separated from each other in a front and a rear direction; and a switching valve mechanism configured to switch the front chamber into communication with a low pressure circuit when the piston advances, and to switch the front chamber into communication with a high pressure circuit when the piston retracts, and to supply and discharge hydraulic oil so that an advance and a retraction of the piston can be repeated, wherein the front chamber has a front-chamber liner that is fitted to an inner surface of the cylinder, a hydraulic chamber space is formed in the front-chamber liner as a cushion chamber, the hydraulic chamber space communicating with the front chamber to be filled with hydraulic oil, and the cushion chamber has a second drain circuit that is formed separately from a first drain circuit, the first drain circuit configured to guide hydraulic oil passing a liner bearing section of the front-chamber liner, the separate second drain circuit positioned in front of the front chamber at a position in an axial direction between the liner bearing section and the front chamber, the second drain circuit configured to guide hydraulic oil to the low pressure circuit without passing through the first drain circuit.

2. The hydraulic hammering device according to claim 1, wherein the second drain circuit is configured to always communicate hydraulic oil in the cushion chamber with the low pressure circuit by way of at least one communication hole without passing through the first drain circuit; and a total passage area of the at least one communication hole is, with respect to an amount of clearance of the liner bearing section, set to an area within a predetermined range that is defined by an expression below:

$$0.1Apf<A<2.5Apf,$$

where:

Apf is an amount of clearance of a liner bearing section, the amount of clearance of the liner bearing section is an area of annular clearance formed by opposing clearance in radially inward and outward directions between a predetermined diameter section of the piston and a sliding contact surface of an inner periphery of the front-chamber liner, and A is the total passage area.

3. The hydraulic hammering device according to claim 2, wherein the front-chamber liner has, as each of the at least one communication hole, a radial communication passage communicating with the cushion chamber and is formed in a penetrating manner separated from each other in the circumferential direction along a radial direction and an axial communication passage including a slit formed along the axial direction on an outer peripheral surface of the front-chamber liner, the slit being formed at a position in alignment with a position of the radial communication passage so as to communicate with the radial communication passage, a drain port that communicates with the axial communication passage is formed between an outer peripheral surface of a front end side portion of the front-chamber liner and an inner peripheral surface of the cylinder and a low pressure port that is always in communication with the low pressure circuit is connected to the drain port, and the second drain circuit always communicates hydraulic oil in the cushion chamber with the low pressure circuit by way of the radial communication passage, the axial communication passage, and the drain port in this order.

4. The hydraulic hammering device according to claim 1, wherein:

the front-chamber liner includes a front liner and a rear liner into which the front-chamber liner is halved in an axially front and rear direction, and the front liner is made of a copper alloy and functions as a bearing member configured to support sliding of the piston, and the rear liner is made of an alloy that has a higher mechanical strength than that of the front liner.

5. The hydraulic hammering device according to claim 4, wherein the hydraulic hammering device includes, on an inner surface of the cylinder, a front-chamber port that is formed in an annular shape in an opposing manner to an outer peripheral surface of a rear side of the rear liner, and a front-chamber passage configured to switch high and low pressure of hydraulic oil in the front chamber is connected to the front-chamber port so as to communicate with the front-chamber port, and the rear liner is extended to a position opposing the front-chamber port, and, on a surface opposing the front-chamber port, a plurality of through holes separated from each other in the circumferential direction are formed in a penetrating manner in radial directions.

6. The hydraulic hammering device according to claim 1, wherein:

the cushion chamber has a first ring section at a rear end section side of the cushion chamber and a second ring section that is formed in front of and adjacent to the first ring section and has a larger diameter than that of the first ring section.

7. The hydraulic hammering device according to claim 6, wherein the second ring section further defines an end face positioned on a front side of the cushion chamber, the end face having a surface that is orthogonal to an axial direction.

* * * * *